US009254852B2

(12) United States Patent
Lawson et al.

(10) Patent No.: US 9,254,852 B2
(45) Date of Patent: Feb. 9, 2016

(54) METHODS AND SYSTEM OF AUTOMATING TRACK CIRCUIT CALIBRATION

(76) Inventors: Richard Lee Lawson, Melbourne Beach, FL (US); Jeffrey Michael Fries, Viera, FL (US); Tom Otsubo, Oak Grove, MO (US)

( * ) Notice: Subject to any disclaimer, the term of this patent is extended or adjusted under 35 U.S.C. 154(b) by 523 days.

(21) Appl. No.: 13/478,448

(22) Filed: May 23, 2012

(65) Prior Publication Data

US 2012/0232813 A1 Sep. 13, 2012

Related U.S. Application Data

(63) Continuation-in-part of application No. 11/970,576, filed on Jan. 8, 2008, now abandoned.

(51) Int. Cl.

| | |
|---|---|
| ***G01R 31/02*** | (2006.01) |
| ***B61L 1/18*** | (2006.01) |
| ***B61L 1/20*** | (2006.01) |

(52) U.S. Cl.

CPC .. *B61L 1/181* (2013.01); *B61L 1/20* (2013.01)

(58) Field of Classification Search

CPC ..... G01R 31/02; B61L 1/18; B61L 1/181; B61L 1/20; G06F 19/00

USPC ..... 702/85, 57–59, 64–65, 81, 84, 105, 702/127, 175–176, 182–183, 185, 702/188–189; 246/20, 26–27, 28 C, 28 F, 246/33, 34 B, 34 R, 41, 58, 70; 324/500, 324/527–528, 537; 701/19

See application file for complete search history.

(56) References Cited

U.S. PATENT DOCUMENTS

| | | | | |
|---|---|---|---|---|
| 4,235,024 | A | 11/1980 | Chauvin et al. | |
| 5,129,605 | A | 7/1992 | Burns et al. | |
| 5,145,131 | A * | 9/1992 | Franke | 246/122 R |
| 5,341,683 | A | 8/1994 | Searle | |

(Continued)

FOREIGN PATENT DOCUMENTS

| | | | |
|---|---|---|---|
| EP | 0539046 | A | 4/1993 |
| WO | 2004071839 | A | 8/2004 |
| WO | 2004076256 | A | 9/2004 |
| WO | 2008052643 | A | 5/2008 |

OTHER PUBLICATIONS

Udo Heinz Kusak: "Ferndiagnose von Signalanlagen und ihre Auswirkung auf die Instandhaltungsstrategie"; Signal + Draht; 87 (1995) Jan./Feb.; No. 1/2; Hamburg, DE.

(Continued)

*Primary Examiner* — Toan Le

(57) ABSTRACT

A method for calibrating a track circuit is provided. The track circuit includes a transmit processing unit, a receive processing unit, and a plurality of rails coupled in series to form a track section having a first end and a second end. The transmit processing unit is coupled to the track section adjacent the first end. The receive processing unit is coupled to the track section adjacent the second end. The method includes operating the transmit processing unit so that a first voltage is applied to the track section, operating the receive processing unit to detect a first current signal, and if a parameter of the first current signal is not within a predetermined acceptable range, then communicating with the transmit processing unit so that the transmit processing unit applies a second voltage to the track section, the second voltage having a different magnitude than the first voltage.

27 Claims, 4 Drawing Sheets

(56) References Cited

U.S. PATENT DOCUMENTS

| | | | |
|---|---|---|---|
| 5,769,364 | A | 6/1998 | Cipollone |
| 5,868,360 | A | 2/1999 | Bader et al. |
| 6,102,340 | A | 8/2000 | Peek et al. |
| 6,371,417 | B1 | 4/2002 | Southon |
| 6,603,356 | B1 | 8/2003 | Kim et al. |
| 7,155,358 | B2 | 12/2006 | Bamfield et al. |
| 7,226,021 | B1 | 6/2007 | Anderson et al. |
| 2002/0113170 | A1 | 8/2002 | Grappone |
| 2004/0172216 | A1 | 9/2004 | Davenport et al. |
| 2006/0155433 | A1 | 7/2006 | Oguma et al. |
| 2006/0202860 | A1 | 9/2006 | Tsai et al. |
| 2007/0001058 | A1 | 1/2007 | Severson |
| 2007/0132463 | A1 | 6/2007 | Anderson |

OTHER PUBLICATIONS

Wendt, F. et al.: "Das Prufgerat SICO 2049 fur Achszahlpunkte ZP 30 und Radsensoren RSL"; vol. 12790; Sep. 2007; pp. 17-21.

PCT International Search Report related to Application No. PCT/US2009/030175 dated Mar. 16, 2009.

PCT Preliminary Report on Patentability related to Application No. PCT/US2009/030175 dated Jul. 22, 2010.

American Hakko Products, "Hakko 192 Calibration Instructions".

Canadian Office Action issued in connection with corresponding CA Application No. 2711422 on Jun. 11, 2013.

* cited by examiner

METHODS AND SYSTEM OF AUTOMATING TRACK CIRCUIT CALIBRATION

CROSS-REFERENCE TO RELATED APPLICATIONS

This application claims priority to and is a continuation-in-part of U.S. application Ser. No. 11/970,576 filed Jan. 8, 2008, now abandoned and incorporated herein by reference in its entirety.

BACKGROUND OF THE INVENTION

This invention relates generally to railroad systems, and more specifically, to methods and system of automatically calibrating track circuits.

A rail track circuit typically is used to detect whether a train is present on a track section. Such circuit also can be used to detect broken rails within the track section and/or can be used to transmit signal aspect information through the rails. A typical track circuit includes rails in electrical series with a signal transmitter and a signal receiver. The signal transmitter applies a voltage, sometimes referred to as a transmit voltage, to the rails. As a result, a current signal, sometimes referred to as a receive current, is transmitted through the rails. The receive current is detected by the receiver.

When a train composed of one or multiple railcars is located on the track section of the track circuit, the wheels of the railcars act as a shunt between the rails and form a shunt path. The shunt path creates an electrical short between the rails at the location of the train, and such short path effectively prevents the receive current from being received/detected by the signal receiver.

Over time, environmental conditions and rail conditions can change. These changing conditions impact ballast resistance of the track circuit. Generally, leakage paths occur through the ballast, and the leakage resistance of such paths varies due to the changing conditions. The varying leakage resistance impacts the receive current. The track circuit therefore is configured, or calibrated, to operate over a range of ballast resistance.

Due to the changing conditions, over time, the track circuit may require re-calibration. Known calibration techniques involve positioning human "maintainers" with two-way radios at the transmitter and receiver. The maintainer at the transmitter communicates data related to the applied voltage to the maintainer at the receiver. The receiver maintainer then informs the transmitter maintainer of the current signal received at the receiver. Adjustments are made to both the transmitter and receiver so that the track circuit operates as desired over the ballast resistance range. Another known calibration technique is for a single human maintainer to perform track circuit calibration by traveling between transmitter and receiver sites (i.e., locations) to make each adjustment. As such, the process of manually calibrating the track circuit settings may be costly, inefficient, and/or time-consuming.

BRIEF DESCRIPTION OF THE INVENTION

An embodiment relates to a method for calibrating a track circuit defined between a transmit processing unit and a receive processing unit. The transmit and processing units are coupled at respective first and second ends of a track section. The method comprises applying a first voltage to the track section by the transmit processing unit, and receiving by the receive processing unit a first current related to the first voltage and a leakage resistance between the first end and the second end of the track section. The method further comprises transmitting from the receive processing unit to the transmit processing unit a communication corresponding to a status of the leakage resistance. The communication includes a pulse pair signal.

Another embodiment relates to a track circuit. The track circuit comprises a receive processing unit coupled to a first end of a track section. The receive processing unit is configured to receive a current signal over the track section. The current signal is related to a voltage signal applied to the track section by a transmit processing unit coupled to a second end of the track section and a leakage resistance between the first end and the second end of the track section. The receive processing unit is configured to transmit to the transmit processing unit a communication corresponding to a status of the leakage resistance. The communication includes a pulse pair signal (signal comprising a pair of pulses).

In another embodiment of a track circuit, the track circuit comprises a transmit processing unit coupled to a first end of a track section. The transmit processing unit is configured to apply a voltage signal to the track section for reception of a current signal corresponding to the voltage signal by a receive processing unit coupled to a second end of the track section. The transmit processing unit is configured to receive a communication from the receive processing unit corresponding to a status of a leakage resistance between the first end and the second end of the track section. The communication includes a pulse pair signal. The transmit processing unit is configured to adjust the voltage signal based on the pulse pair signal received from the receive processing unit to compensate for the leakage resistance.

In an embodiment, the track circuit including the transmit processing and receive processing units are configured to operate automatically to calibrate the track circuit according to the leakage ballast. In an embodiment, the track circuit is configured to calibrate or re-calibrate the transmit and receive units periodically based on time. In another embodiment, the calibration process is automatically initiated based on a change in a parameter having an effect on the conductivity of the ballast or leakage resistance such as rain or snow or changes in weather or temperature.

Another embodiment relates to a track circuit. The track circuit comprises a remote system and a transmit processing unit and a receive processing unit. The remote system is configured for communication with at least one of the transmit processing unit or the receive processing unit. The transmit processing unit is coupled to a first end of a track section. The track section comprises a plurality of rails coupled in series and having the first end and a second end. The receive processing unit is coupled to the second end of the track section. The transmit processing unit is configured to apply a first voltage to the track section during a track circuit calibration operation. The receive processing unit is configured to detect a first current related to the first voltage and a leakage resistance between the first end and the second end. The receive processing unit is configured to transmit a pulse pair to the transmit processing unit indicative of a state of adjustment necessary in the first voltage to compensate for the leakage resistance. The receive processing unit is configured to timingly separate the pulses of the pulse pair. The timing of the separation indicates a status of the first current relative to a predetermined range.

In another embodiment of a track circuit, the track circuit comprises a transmit processing unit and a receive processing unit for cooperatively monitoring and calibrating a track circuit. The transmit processing unit is coupled to a first end of a track section, and the receive processing unit is coupled to a second end of the track section. The transmit processing unit is configured to apply a first voltage to the track section. The receive processing unit is configured to detect a first current related to the first voltage and a leakage resistance between the first end and the second end of the track section. The receive processing unit is configured to transmit a pulse pair signal to the transmit processing unit indicating the status of the first current relative to a predetermined range. The transmit processing unit is configured to apply a different, second voltage to the track section if the first current is outside the predetermined range.

In another embodiment a method for calibrating a track circuit is provided. The track circuit includes a transmit processing unit, a receive processing unit, and a plurality of rails coupled in series to form a track section having a first end and a second end. The transmit processing unit is coupled to the track section adjacent the first end. The receive processing unit is coupled to the track section adjacent the second end. The method includes operating the transmit processing unit so that a first voltage is applied to the track section, operating the receive processing unit to detect a first current signal, and if a parameter of the first current signal is not within a predetermined acceptable range, then communicating with the transmit processing unit so that the transmit processing unit applies a second voltage to the track section, the second voltage having a different magnitude than the first voltage.

In another embodiment, a track circuit is provided. The track circuit includes a remote system, a transmit processing unit, and a receive processing unit. The remote system is configured to electronically couple to at least one of the transmit processing unit and the receive processing unit. The track circuit further includes a plurality of rails coupled in series to form a track section having a first end and a second end. The transmit processing unit coupled to the track section adjacent the first end. The receive processing unit coupled to the track section adjacent the second end. The transmit processing unit is configured to apply a first voltage to the track section during operation. The receive processing unit is configured to detect a first current signal during operation. If a parameter of the first current signal is not within a predetermined acceptable range, then the receive processing unit is configured to communicate with the transmit processing unit such that the transmit processing unit applies a second voltage to the track section. The second voltage has a different magnitude than the first voltage.

In another embodiment, a track circuit is provided. The track circuit includes a transmit processing unit, a receive processing unit, and a plurality of rails coupled in series to form a track section having a first end and a second end. The transmit processing unit is coupled to the track section adjacent the first end. The receive processing unit coupled to the track section adjacent the second end. The transmit processing unit is configured to apply a first voltage to the track section during operation, and the receive processing unit is configured to detect a first current signal during operation. If a parameter of the first current signal is not within a predetermined acceptable range, then the receive processing unit is configured to communicate with the transmit processing unit such that the transmit processing unit applies a second voltage to the track section. The second voltage has a different magnitude than the first voltage.

DETAILED DESCRIPTION OF THE INVENTION

Figure 1:
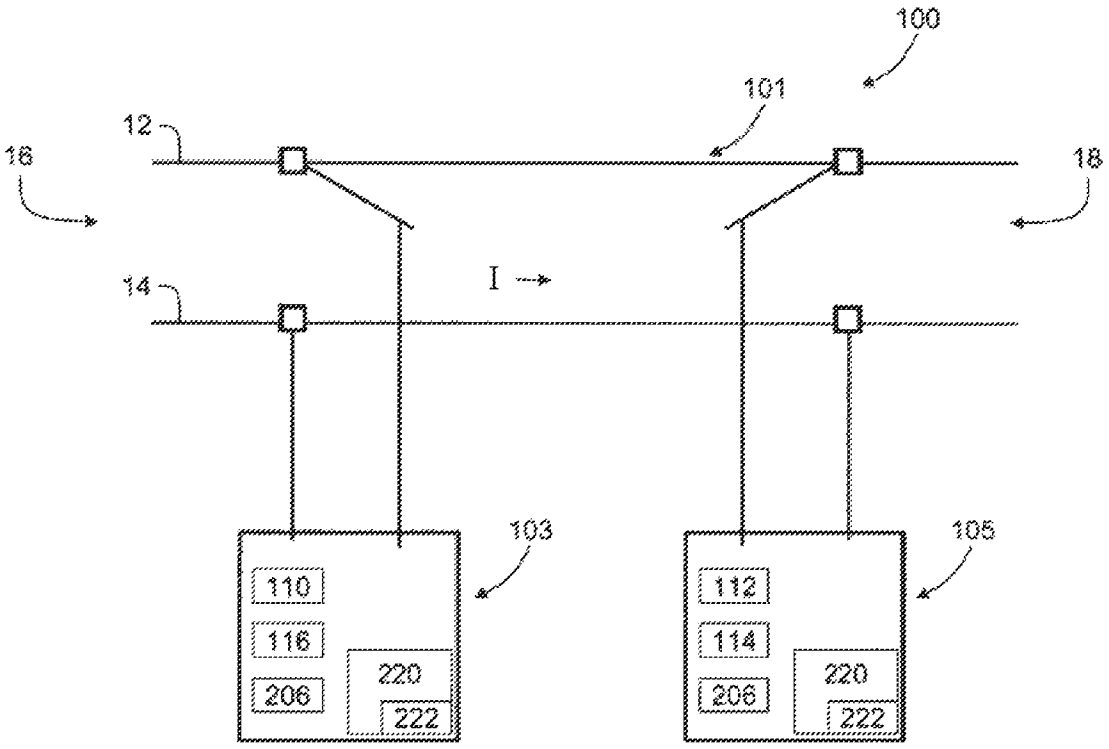
FIG. 1 is a schematic illustration of a track circuit.

FIG. 1 is a schematic illustration of at least one track circuit 100 in accordance with an exemplary embodiment of the present invention. The track circuit 100 is configured for automatic evaluation and calibration of a section of the railroad track. Track circuit 100 includes a plurality of rails 12 and 14 coupled in series to form a track section 101 having a first end 16 and a second end 18. The track section 101 may include a plurality of ties (not shown) coupling rails 12 and 14 together. The ties are laid in the ground and substantially covered with ballast (e.g., small stones) to hold the ties in place. Over time, environmental conditions and rail conditions can change. The changing conditions impact ballast resistance of track circuit 100. Generally, leakage paths occur through the ballast, and the leakage resistance impacts the current levels. The track circuit 100 therefore is configured, or calibrated, to operate over a range of ballast resistance, as will be discussed in more detail below.

The track circuit 100 further includes a first processing unit 103 and a second processing unit 105 (also referred to as first and second units). In an embodiment, in at least one mode of operation, the first processing unit 103 operates as a transmit processing unit, and the second processing unit 105 operates as a receive processing unit. In another embodiment, adjustments are made to both units 103 and 105 so that track circuit 100 operates as desired over a given ballast resistance range. The first processing unit 103 is coupled to adjacent track section first end 16, and the second processing unit 105 is coupled to adjacent track section second end 18. In an embodiment, the first processing unit 103 is configured as a transmit processing unit to apply a first voltage across track section 101 during operation. For example, the transmit processing unit 103 may be configured to apply a positive voltage across track section 101 at end 16 (positive relative to a voltage at the receive processing unit 105), thereby generating a current in a direction "I" shown in FIG. 1. The second processing unit 105 is configured as a receive processing unit to detect a first current through, for example, track section 101 at end 18. In an alternative embodiment, the first 103 has similar components and similar functionality as the second processing unit 105, and the second unit 105 has similar components and similar functionality as the first unit 103.

In an embodiment, the first processing unit 103 includes at least one energy source 110 and at least one receiver 116, and the second processing unit 105 includes at least one energy source 112 and at least one receiver 114. ("Receiver" refers to a device for transmitting and/or receiving electrical signals over a rail.) Moreover, each unit 103, 105 includes at least one arithmetic logic unit or other programmable controller, and (in some embodiments) non-transient program instructions (software) accessible by the controller, which when accessed and executed by the controller cause the controller to carry out one or more designated functions based on the contents of the instructions. In an alternative embodiment, each unit 103, 105 does not include at least one arithmetic logic unit or other programmable controller. Generally, each unit 103, 105 of a coded track circuit includes arithmetic logic units or other programmable controllers, and each unit 103, 105 of a non-coded track circuit does not include arithmetic logic units or other programmable controllers. For example, non-coded track circuit units may have only electrical circuitry for an on or off current detection. With an on or off current detections, the on or off transmit voltage needs to be high enough to allow for current detection.

In an embodiment, the program instructions are non-transiently stored in respective memory devices 206 within the first unit 103 and/or the second unit 105. The memory device 206 may be an electrically erasable programmable read only member (hereinafter "EEPROM"). Alternatively, other types of memory could be utilized, such as simple read only memory (ROM), or programmable read only member (PROM), or, if the ability to reprogram the ROM is desirable, erasable programmable read only memory (EPROM), which are conventionally erased by exposure to ultraviolet light, or FLASH memory.

The track circuit 100 may be calibrated, operated, and monitored from a remote location. For example, in one embodiment, first and second processing units 103 and 105 are configured to communicate with a remote system (not shown) via a wireless network. In an embodiment, communication between the remote system and units 103, 105 is based on a client-server relationship using established protocols such as, but not limited to, Internet Protocol (IP). In an alternative embodiment, communication between the remote system and units 103, 105 may include any suitable means that enables track circuit 100 to function as described herein.

Figure 2:
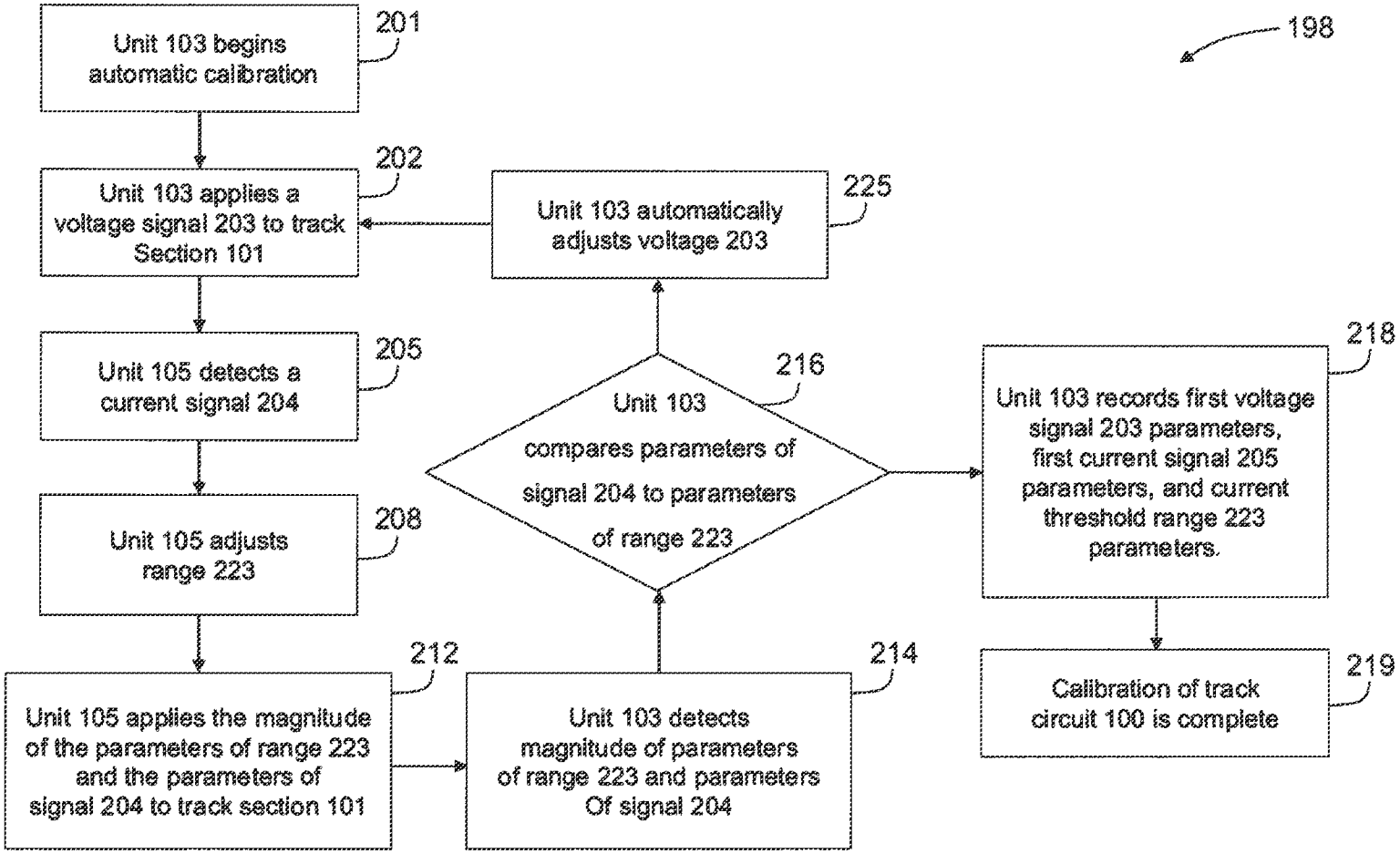
FIG. 2 is a flowchart depicting a method of calibrating the track circuit shown in FIG. 1.

FIG. 2 is a flowchart 198 depicting a method of calibrating at least a portion of track circuit 100, according to an embodiment of the invention. Each unit 103, 105 is selectively operable between a calibration mode and an operational mode. In an embodiment, a railroad operator (i.e., a human "maintainer") selects local calibration mode 199 to begin 201 calibration of track section 101. In other embodiments, the calibration mode is commenced remotely (e.g., wirelessly from a remote system), and automatically periodically based on stored program instructions of the units 103, 105 or otherwise.

In an embodiment, the first processing unit 103 is configured to operate as a transmit processing unit to apply 202 a voltage "V" 203 across track section 101, and the second processing unit 105 is configured operate as a receive processing unit to detect 205 a current "I" 204 flowing through track section 101. In an alternative embodiment, the track section 101 is calibrated in a substantially similar matter to the method described herein; however, the second unit 105 is configured to apply 202 voltage 203 across track section 101, and the first unit 103 is configured to detect current 204 flowing through track section 101. In another embodiment, each unit 103, 105 is configured to both transmit and receive signals, and in one mode of operation the first unit 103 transmits signals (e.g., voltage V) and the second unit 105 receives signals (e.g., current I), and in another mode of operation the second unit 105 transmits signals (e.g., voltage V) and the first unit 103 receives signals (e.g., current I). In another embodiment, calibration is automatically carried out first by one of the units transmitting a first signal and the other of the units receiving the first signal, followed by the other of the units transmitting a second signal and the one of the units receiving the second signal.

Moreover, in an embodiment, at least one of the first unit 103 and/or the second unit 105 includes memory device 206 for at least temporarily storing various voltage and current parameters and a predetermined current threshold range 223. For example, the transmit voltage may be approximately 2 volts while the receive current parameter may be approximately 1.5 amps and the threshold range may be set at approximately 0.5 amps. The predetermined current threshold range 223 may be input as a suggested threshold by the maintainer. In an embodiment, the predetermined current threshold range 223 is approximately 0.5-6.0 amps. In an alternative embodiment, the predetermined current threshold range 223 is pre-programmed within unit 105 (and/or unit 103).

In an embodiment, the second unit 105 (and/or the first unit 103) is configured to adjust 208 the range 223 based upon the changing ballast condition. For example, if the track circuit is set up by the maintainer when the ballast leakage is low (i.e., good conduction down the rail), then the transmit voltage may be set to approximately 1 volt and the receive current may be approximately 2 amps. For example, if a train is detected in the track circuit, the train shorts the rails in the track circuit causing a small amount of current to be received at the second unit 105 (i.e., receiver). As such, the threshold could be set to approximately 0.6 amps such that if the receive current is below 0.6 amps, the track circuit will declare that a train is on the track circuit. However, if the ballast leakage increases (i.e., low conduction down the rail exists), then the receive current will be less due to the ballast leakage. Therefore, if the receive current drops below 0.6 amps at the second unit 105 (i.e., receiver), a train is "detected" on the track circuit due to the ballast conditions even though no train actually occupies the track. As such, range 223 is adjusted based upon the changing ballast conditions.

Once current threshold range 223 has been adjusted based upon the ballast conditions, the second unit 105 is configured to apply 212 the magnitude of range 223 and the parameters of signal 204 across track section 101, and the first unit 103 is configured to detect 214 the magnitude of range 223 and signal 204 flowing through track section 101.

In another embodiment, at least one of unit 103 and/or unit 105 also includes a logic module 220 including a function block 222 embodied as program instructions. Function block 222 within unit 103 and/or unit 105 is configured to compare 216 at least one parameter of a detected current signal to the current threshold range 223.

After comparison of a parameter of the current signal 204 to the current threshold range 223, if a parameter of current signal 204 is not within the range, then the first unit 103 is configured to automatically adjust 225 voltage 203 and the first unit 103 is configured to apply a second voltage across track section 101. The second voltage has a different magnitude than the first voltage 203, and the method, described herein, repeats until a predetermined parameter of current signal 204 is within the range 223.

On the other hand, after comparison of a parameter of the current signal 204 to the current threshold range 223, if the current signal 204 is within the range 223, then the second unit 105 is configured to communicate with the first unit 103 such that the first unit 103 maintains the magnitude of first voltage signal 203. Moreover, if the current signal 204 is within the range 223, then the second unit 105 is configured to communicate with the first unit 103 such that the first unit 103 records first voltage signal 203 parameters, first current signal 204 parameters, and current threshold range 223 parameters.

A mechanism that could be used to communicate track circuit adjustment information between two ends (two units) of a track circuit is as follows. This mechanism could be used during the initial calibration phase and also as a means of continual or periodic adjustment during operation.

Figure 4:
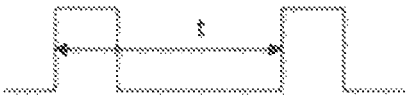
FIGS. 4-6 are diagrams showing various embodiments of a pulse pair signal generated via a receive processing unit of the disclosed track circuit.
Figure 5:
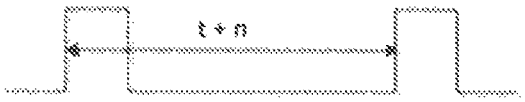
Figure 6:
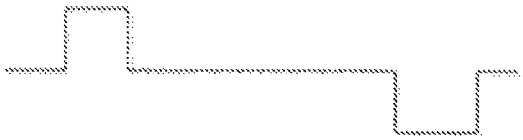

Referring to FIGS. 4-6, in one embodiment, when a track circuit is calibrated, the transmitter output of the first unit 103 is adjusted/set to a value and the receiver threshold of the other, second unit 105 is set based on the magnitude of a received track code pulse. This transmitter 103 output/receiver 105 threshold relationship facilitates track circuit calibration and adjustment, as maladjustment can be a source of: 1) a track circuit that appears to be occupied when no train is present (transmitter set too low/receiver threshold set too high); or 2) a track circuit that appears to be unoccupied when a train is present (transmitter set too high/receiver threshold set too low). Since the magnitude of the transmitted signal at the receiver (second unit) 105 is dependent upon the signal leakage through the track ballast, changes in the rail-to-rail ballast resistance can lower or raise the magnitude of the signal detected at the receiver.

As the receiver (second unit) 105 detects a change in magnitude of the received signal, an adjustment to the transmitted signal can compensate for the changes in the ballast conditions in response to the detected change. In one embodiment, a communication is transmitted from one unit to the other, corresponding to a status of the leakage resistance (status referring whether the leakage resistance is the same or has increased or decreased, and the magnitude of such). For example, the receiver (second unit) 105 may communicate the direction and magnitude of a proposed adjustment to the transmitted signal (to compensate for the ballast leakage resistance) by sending a pulse pair signal via the rail connection to the transmitter (first unit) 103. Designated differences between the signals of the pulse pair (e.g., timing between the pulses and/or a polarity of the pulse pair) can indicate the amount and direction of the requested transmitter output adjustment.

For example, in one embodiment, when the track circuit is operating as calibrated, a pulse pair signal generated and transmitted from the second unit 105 (receiver) to the first unit 103 (transmitter) that is time t apart (t being a designated time period) indicates no transmitter adjustment necessary (see FIG. 4). As ballast conditions change, the timing of the pulse pair is lengthened and/or shortened to indicate the direction of transmitter adjustment (unit 103) needed and the magnitude of adjustment communicated by the magnitude of the time delta (n) as shown in FIG. 5. For example: a time delta of n=0 means no adjustment; a time delta of −n ("n" seconds less than time period t, where n>0) may indicate one of reducing or increasing the transmitted voltage signal V by an amount proportional to the magnitude of "n" (within a designated range); and a time delta of +n ("n" seconds more than time period t, where n>0) may indicate the other of reducing or increasing the transmitted voltage signal V, again by an amount proportional to the magnitude of "n" (within a designated range).

If other signals are present on the rails, one embodiment of the system uses the polarity of the pulses to indicate direction of adjustment or to distinguish the adjustment signal from other signals present. For example, as shown in FIG. 6, a pulse pair signal can include one positive signal portion and one negative signal portion. The pulses of the pulse pair signals can be pulsed DC or pulse modulated carrier depending on the configurations of the transmitting unit 103 and receiver unit 105. A pulsed DC implementation is used to communicate via the rails for a distance of up to approximately 25,000 feet between the transmitter unit 103 and receiver unit 105.

In an embodiment, the pulse pair signals comprise first and second square wave portions, spaced apart by a non-zero time, of equal amplitude, where the non-zero time is indicative of a calibration adjustment based on how much the time deviates from a pre-designated time, if at all, and with a direction of the deviation (more than or less than the pre-designated time) indicative of a direction of the calibration adjustment (increasing or decreasing the value in question) and a magnitude of the deviation indicative of a magnitude of the calibration adjustment. In another embodiment, the pulse pair signals comprise first and second square wave portions, spaced apart by a non-zero time, of different amplitudes, where the first square wave has a designated amplitude, and the amplitude of the second square wave varies as a function of an adjustment to be made, being either the same as the first square wave (indication no adjustment, when no adjustment is required), more than the first square wave (indicating one of a positive or negative adjustment, and with a magnitude of a difference between the square waves indicative of a magnitude of the positive or negative adjustment), or less than the first square wave (indicating the other of the positive or negative adjustment, and again, with a magnitude of a difference between the square waves indicative of a magnitude of the other of the positive or negative adjustment). In another embodiment, the pulse pair signals comprise first and second square wave portions, spaced apart by a non-zero time, of the same amplitude but different pulse durations, where the first square wave has a designated duration (static duration), and the pulse duration of the second square wave varies as a function of an adjustment to be made, being either the same as the first square wave (indication no adjustment, when no adjustment is required), a longer duration than the first square wave (indicating one of a positive or negative adjustment, and with a magnitude of a difference between the durations of the square waves indicative of a magnitude of the positive or negative adjustment), or a shorter duration than the first square wave (indicating the other of the positive or negative adjustment, and again, with a magnitude of a difference between the durations of the square waves indicative of a magnitude of the other of the positive or negative adjustment). Other voltage forms may be used, such as triangle/sawtooth waveforms, square waves with mixed amplitudes and durations, or the like.

In another embodiment, the adjustment signal is transmitted via frequency modulation which also includes transferring of an adjustment signal from unit 105 to unit 103 which does not depend on the magnitude of the signal transferred.

In an embodiment, a timing mechanism (not shown) is coupled to each unit 103, 105. The timing mechanism is configured to switch each respective unit 103, 105 to the operational mode after a predetermined time to prevent units 103, 105 from remaining in calibration mode 199. For example, unit 103 and/or 105 would switch from calibration mode 199 to the operational mode after approximately 1 minute of inactivity in calibration mode 199. The default for switching out of calibration mode 199 may be to a safe default value or to the pre-determined values. In an alternative embodiment, once track section 101 has been calibrated, then the maintainer may return each unit 103 and/or 105 to the operational mode. Moreover, at least one unit 103 and/or 105 may be coupled to an output display (not shown) such that various stored parameters may be output to the display.

During operation, in an embodiment, the maintainer sets the first processing unit 103 to local calibration mode 199 to begin 201 automatic calibration of track section 101. In calibration mode 199, the first unit 103 applies 202 a first voltage signal 203 (e.g., test pulses) across track section 101. In an alternative embodiment, signal 203 is transmitted from unit 103 as a predefined pulse pattern, a message, and/or any other communication media that enables track circuit 100 to function as described herein.

The second unit 105 detects 205 the first current signal 204. In an embodiment, the second unit 105 at least temporarily stores the parameters of signal 203 and range 223 in memory device 206. The second unit 105 may be configured to adjust 208 the range 223 based upon changing ballast conditions.

In an embodiment, the second unit 105 adjusts 208 the range 223 based upon the changing ballast condition. For example, if the track circuit is set up by the maintainer when the ballast leakage is low (i.e., good conduction down the rail), then the transmit voltage may be set to approximately 1 volt and the receive current may be approximately 2 amps. For example, if a train is detected in the track circuit, the train shorts the rails in the track circuit causing a small amount of current to be received at unit 105 (i.e., receiver). As such, the threshold could be set to approximately 0.6 amps such that if the receive current is below 0.6 amps, the track circuit will declare that a train is on the track circuit. However, if the ballast leakage increases (i.e., low conduction down the rail exists), then the receive current will be less due to the ballast leakage. Therefore, if the receive current drops below 0.6 amps at unit 105 (i.e., receiver), a train is "detected" on the track circuit due to the ballast conditions even though no train actually occupies the track. As such, range 223 is adjusted based upon the changing ballast conditions.

Once current threshold range 223 has been adjusted based upon the ballast conditions, the second unit 105 applies 212 the magnitude of range 223 and the parameters of signal 204 across track section 101, and the first unit 103 detects 214 the magnitude of range 223 and signal 204 flowing through track section 101.

Function block 222 within the first unit 103 then compares 216 at least one parameter of signal 204 to the current threshold range 223. In an embodiment, after comparison of a parameter of the current signal 204 to current threshold range 223, if a parameter of the first current signal 204 is not within the current threshold range 223, then the first unit 103 automatically adjusts 225 first voltage 203 to a second voltage. Specifically, in an embodiment, the second voltage has a different magnitude than the first voltage signal 203. The first unit 103 then applies 202 the second voltage across the track section 101. As such, the second unit 105 detects a second current, and the method repeats until a predetermined parameter of the current signal is within the range.

On the other hand, if after comparison of a parameter of the current signal 204 to the current threshold range 223, the parameter current signal 204 is within the range, then the first unit 103 maintains the magnitude of first voltage signal 203. Moreover, in an embodiment, if the current signal 204 is within range 223, then the first unit 103 records 218 first voltage signal 203 parameters, first current signal 204 parameters, and current threshold range 223 parameters. Calibration of track section 101 is complete 219 when the various parameters have been recorded by the first unit 103.

In another embodiment, when calibration of track section 101 is complete, the timing mechanism (not shown) switches each respective unit 103 and 105 to the operational mode after a predetermined time to prevent units 103 and 105 from remaining in calibration mode 199. For example, unit 103 and/or 105 would switch from calibration mode 199 to the operational mode after approximately 1 minute of inactivity in calibration mode 199. The default for switching out of calibration mode 199 may be to a safe default value or to the pre-determined values. In an alternative embodiment, once track section 101 has been calibrated, then the maintainer may return each unit 103 and/or 105 to the operational mode. Moreover, at least one unit 103 and/or 105 may be coupled to an output display (not shown) such that various stored parameters may be output to the display.

Figure 3:
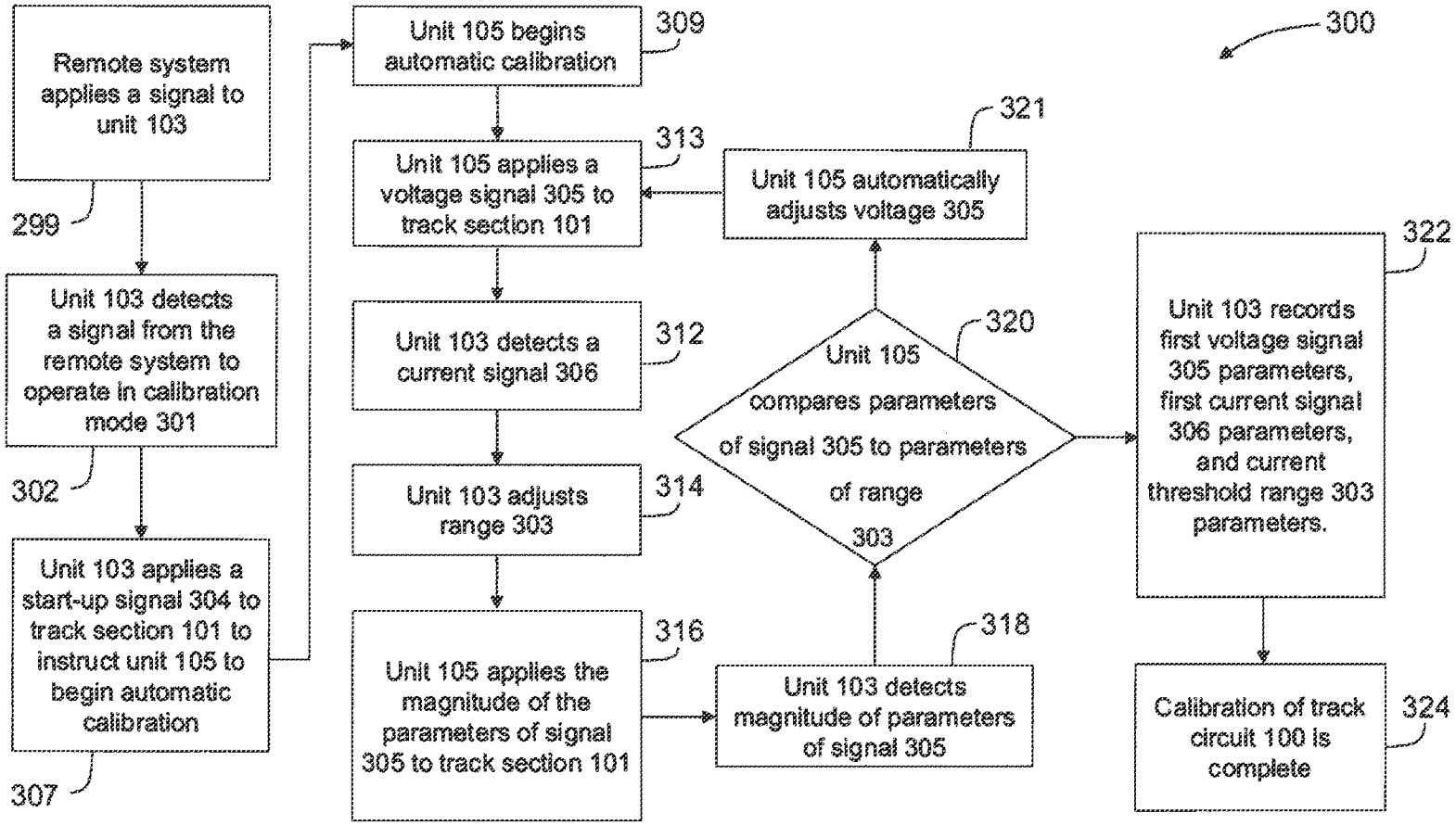
FIG. 3 is a flowchart depicting a method of calibrating the track circuit 100 shown in FIG. 1 from a remote location.

FIG. 3 is a flowchart 300 depicting a method of calibrating at least a portion of track circuit 100 from a remote location. In the exemplary embodiment, each unit 103 and 105 is selectively operable between a calibration mode 301 and an operational mode. In an embodiment, track circuit 100 may be calibrated, operated, and monitored from a remote location using a remote system configured to apply a signal to at least one of unit 103 and/or unit 105. For example, the units 103 and 105 may be configured to communicate with the remote system (not shown) via a wireless network (not shown). In an alternative embodiment, a railroad operator (i.e., a human "maintainer") selects remote calibration mode 301 to begin calibration of track section 101.

In an embodiment, the remote system is configured to apply 299 a signal to the first unit 103 instructing the first unit 103 to operate in calibration mode 301, and the first unit 103 is configured to detect 302 the signal from the remote system. The first unit 103 is configured to apply 307 a start-up signal 304 across track section 101. The second unit 105 is configured to detect signal 304 and is configured to begin 309 automatic calibration of track section 101. As such, the unit 105 is configured to apply 313 a voltage signal 305 across track section 101, and the first unit 103 is configured to detect 312 a current signal 306 flowing through track section 101. In an alternative embodiment, the remote system is configured to apply a signal to track section 101 instructing the second unit 105 to operate in calibration mode 301. As such, the track section 101 is calibrated in a substantially similar matter to the method described herein.

In an embodiment, at least one of unit 103 and/or unit 105 includes a memory device 206 for at least temporarily storing various parameters and a current threshold range. The current threshold range 303 may be input into unit 103 as a suggested threshold by the maintainer. In an alternative embodiment, the current threshold range 303 is pre-programmed within units 103 and/or 105. In another embodiment, the first unit 103 is configured to adjust the range 303 based upon changing ballast conditions. For example, if the track circuit is set up by the maintainer when the ballast leakage is low (i.e., good conduction down the rail), then the transmit voltage may be set to approximately 1 volt and the receive current may be approximately 2 amps. For example, if a train is detected in the track circuit, the train shorts the rails in the track circuit causing a small amount of current to be received at the receiver unit. As such, the threshold could be set to approximately 0.6 amps such that if the receive current is below 0.6 amps, the track circuit will declare that a train is on the track circuit. However, if the ballast leakage increases (i.e., low conduction down the rail exists), then the receive current will be less due to the ballast leakage. Therefore, if the receive current drops below 0.6 amps at the receiver unit, a train is "detected" on the track circuit due to the ballast conditions even though no train actually occupies the track. As such, range 303 is adjusted based upon the changing ballast conditions.

Once current threshold range 303 has been adjusted based upon the ballast conditions, the second unit 105 is configured to apply 316 the magnitude of range 303 and the parameters of signal 305 across track section 101, and the first unit 103 is configured to detect 318 the magnitude of range 303 and signal 305 flowing through track section 101.

In another embodiment, at least one of the first unit 103 and/or the second unit 105 also includes a logic module 220 including a function block 222 embodied as software. The function block 222 within the second unit 105 is configured to compare at least one parameter of a detected signal to a threshold range. After comparison of a parameter of current signal 306 to current threshold range 303, if a parameter of current signal 306 is not within the range, then the second unit 105 is configured to apply a second voltage across track section 101. In an embodiment, the second voltage has a different magnitude than the first voltage 305, and the method, described herein, repeats until a predetermined parameter of current signal 306 is within the range 303.

On the other hand, after comparison of a parameter of current signal 306 to predetermined current threshold range 303, if a parameter of current signal 306 is within the range, then the second unit 105 maintains the magnitude of first voltage signal 305. Moreover, in the exemplary embodiment, if current signal 306 is within range 303, then the second unit 105 communicates with the first unit 103 such that the first unit 103 records first voltage signal 305 parameters, first current signal 306 parameters, and current threshold range 303 parameters.

In an embodiment, a timing mechanism (not shown) is coupled to at least one unit 103 and/or 105. Once unit 103 records first voltage signal 305 parameters, first current signal 306 parameters, and current threshold range 303 parameters, calibration is substantially complete, and the remote system is configured to apply a signal to the timing mechanism. The signal is configured to switch the timing mechanism from calibration mode 301 to the operational mode to prevent units 103 and 105 from remaining in calibration mode 301. In an alternative embodiment, each timing mechanism is configured to switch from calibration mode 301 to the operational mode after a predetermined time to prevent units 103 and 105 from remaining in calibration mode 301. In a further alternative embodiment, once track section 101 has been calibrated, then the maintainer may return each unit 103 and/or 105 to the operational mode. Moreover, at least one unit 103 and/or 105 may be coupled to an output display (not shown) such that various stored parameters may be output to the display.

During operation, in an embodiment, the remote system applies 299 a signal to the first unit 103 instructing the first unit 103 to operate in calibration mode 301, and the first unit 103 detects 302 the signal. The first unit 103 communicates with unit 105 such that the second unit 105 applies 307 a start-up signal across track section 101 to begin calibration of track section 101. In an embodiment, in calibration mode 301, the first unit 103 applies 307 a start-up signal 304 to the second unit 105. Start-up signal 304 instructs the second unit 105 to begin calibration or re-calibration of track section 101, and the second unit 105 begins 309 calibration or re-calibration. In the exemplary embodiment, the second unit 105 applies 313 first voltage signal 305 across track section 101. In an alternative embodiment, signal 305 is applied across track section 101 as a predefined pulse pattern, a message, and/or any other communication media that enables track circuit 100 to function as described herein.

In an embodiment, the first unit 103 detects 312 a first current signal 306. The first unit 103 at least temporarily stores the parameters of current signal 306 in memory device 206. In the exemplary embodiment, the first unit 103 adjusts 314 the range 303 based upon the changes in the condition of the ballast described herein above. When a train enters a track circuit, the received current drops suddenly and is, therefore, distinguishable from ballast deterioration which causes the receive current to drop much more slowly.

For example, if the track circuit is set up by the maintainer when the ballast leakage is low (i.e., good conduction down the rail), then the transmit voltage may be set to approximately 1 volt and the receive current may be approximately 2 amps. For example, if a train is detected in the track circuit, the train shorts the rails in the track circuit causing a small amount of current to be received at the receiver unit. As such, the threshold could be set to approximately 0.6 amps such that if the receive current is below 0.6 amps, the track circuit will declare that a train is on the track circuit. However, if the ballast leakage increases (i.e., low conduction down the rail exists), then the receive current will be less due to the ballast leakage. Therefore, if the receive current drops below 0.6 amps at the receiver unit, a train is "detected" on the track circuit due to the ballast conditions even though no train actually occupies the track. As such, range 303 is adjusted based upon the changing ballast conditions.

Once range 303 has been adjusted, the second unit 105 applies 316 the magnitude of the parameters signal 305 across track section 101 such that the first unit 103 detects 318 the magnitude of the parameters of signal 305.

Function block 222 within the second unit 105 compares 320 at least one parameter of current signal 306 to the current threshold range 303. In the exemplary embodiment, after comparison of a parameter of current signal 306 to predetermined current threshold range 303, if a parameter of the current signal 306 is not within the predetermined current threshold range 303, then the second unit 105 automatically adjusts 321 voltage 305 and applies 313 a second voltage across track section 101. Specifically, in an embodiment, the second voltage has a different magnitude than the first voltage 305. As such, the first unit 103 detects a second current, and the method repeats until a predetermined parameter of current signal 306 is within the range 303.

On the other hand, if after comparison of a parameter of first current signal 306 is within the predetermined current threshold range 303, the parameter current signal 306 is within the range, then the second unit 105 maintains the magnitude of first voltage signal 305. Moreover, if the current signal 306 is within range 303, then the second unit 105 communicates with the first unit 103 such that unit 103 records 322 first voltage signal 305 parameters, first current signal 306 parameters, and current threshold range 303 parameters within memory device 206.

Calibration of track section 101 is complete 324 when the various parameters have been recorded by unit 103. In the exemplary embodiment, once track section 101 is complete, the remote system communicates with at least one of the timing mechanisms (not shown) coupled to unit 103 and/or unit 105 such that the remote system instructs the timing mechanism to switch each respective unit 103 and/or 105 to the operational mode from calibration mode 301 to prevent units 103 and/or 105 from remaining in calibration mode 301. In an alternative embodiment, each timing mechanism switches from calibration mode 301 to the operational mode after a predetermined time to prevent units 103 and 105 from remaining in calibration mode 301. In a further alternative embodiment, once track section 101 has been calibrated, then the maintainer may return each unit 103 and/or 105 to the operational mode. Moreover, at least one unit 103 and/or 105 may be coupled to an output display (not shown) such that various stored parameters are output to the display.

An embodiment relates to a method for calibrating a track circuit defined between a transmit processing unit and a receive processing unit. The transmit and processing units are coupled at respective first and second ends of a track section. The method comprises applying a first voltage to the track section by the transmit processing unit, and receiving by the receive processing unit a first current related to the first voltage and a leakage resistance between the first end and the second end of the track section. The method further comprises transmitting from the receive processing unit to the transmit processing unit a communication corresponding to a status of the leakage resistance. The communication includes a pulse pair signal.

In another embodiment of the method, the method further comprises determining if the first current is within a predetermined range, and adjusting the first voltage if the first current is outside the predetermined range.

In another embodiment of the method, the step of transmitting further comprises separating the pulse pair by a timing indicating a required change in the first voltage to compensate for the leakage resistance.

In another embodiment of the method, the step of transmitting further comprises the timing separating the pulse pair being a designated time period adjusted by a time delta, wherein the time delta indicates a required change in the first voltage to compensate for the leakage resistance.

In another embodiment of the method, the method further comprises applying a second voltage to the track section if the time delta is greater than zero. The second voltage has a different magnitude than the first voltage. The method further comprises receiving by the receive processing unit a second current corresponding to the second voltage, and adjusting a predetermined range for the first current based on the leakage resistance for maintaining operation of the track circuit over a range of leakage resistance. The timing of the pulse pair is indicative of a direction of the transmitter adjustment.

In another embodiment of the method, a magnitude of adjustment for the first voltage is communicated to the transmit processing unit by a magnitude of a change in the timing of the pulse pair.

In another embodiment of the method, the method further comprises operating the receive processing unit to detect the first current, and if a parameter of the first current is within a predetermined range, then communicating with the transmit processing unit so that the transmit processing unit records at least one of a magnitude of the first voltage or a magnitude of the first current.

In another embodiment of the method, the method further comprises operating at least one of the transmit processing unit or the receive processing unit such that when at least one of the magnitude of the first voltage or the magnitude of the first current is recorded, the track circuit calibration is complete.

In another embodiment of the method, at least one of the transmit processing unit or the receive processing unit is coupled for communication with a remote system. The method further comprises operating the remote system for calibrating the track circuit from the remote system.

Another embodiment relates to a track circuit. The track circuit comprises a receive processing unit coupled to a first end of a track section. The receive processing unit is configured to receive a current signal over the track section. The current signal is related to a voltage signal applied to the track section by a transmit processing unit coupled to a second end of the track section and a leakage resistance between the first end and the second end of the track section. The receive processing unit is configured to transmit to the transmit processing unit a communication corresponding to a status of the leakage resistance. The communication includes a pulse pair signal (signal comprising a pair of pulses).

In another embodiment of the track circuit, the receive processing unit is further configured to separate the pulse pair by a timing indicative of a required change in the voltage signal to compensate for the leakage resistance.

In another embodiment of the track circuit, the timing separating the pulse pair is a designated time period adjusted by a time delta. The time delta is indicative of the required change in the voltage signal to compensate for the leakage resistance.

In another embodiment of a track circuit, the track circuit comprises a transmit processing unit coupled to a first end of a track section. The transmit processing unit is configured to apply a voltage signal to the track section for reception of a current signal corresponding to the voltage signal by a receive processing unit coupled to a second end of the track section. The transmit processing unit is configured to receive a communication from the receive processing unit corresponding to a status of a leakage resistance between the first end and the second end of the track section. The communication includes a pulse pair signal. The transmit processing unit is configured to adjust the voltage signal based on the pulse pair signal received from the receive processing unit to compensate for the leakage resistance.

In another embodiment of the track circuit, the transmit processing unit is further configured to adjust the voltage signal based on a timing that separates the pulse pair. The timing is indicative of a required change in the voltage signal to compensate for the leakage resistance.

In another embodiment of the track circuit, the timing separating the pulse pair is a designated time period adjusted by a time delta. The time delta is indicative of the required change in the voltage signal to compensate for the leakage resistance.

Another embodiment relates to a track circuit. The track circuit comprises a remote system and a transmit processing unit and a receive processing unit. The remote system is configured for communication with at least one of the transmit processing unit or the receive processing unit. The transmit processing unit is coupled to a first end of a track section. The track section comprises a plurality of rails coupled in series and having the first end and a second end. The receive processing unit is coupled to the second end of the track section. The transmit processing unit is configured to apply a first voltage to the track section during a track circuit calibration operation. The receive processing unit is configured to detect a first current related to the first voltage and a leakage resistance between the first end and the second end. The receive processing unit is configured to transmit a pulse pair to the transmit processing unit indicative of a state of adjustment necessary in the first voltage to compensate for the leakage resistance. The receive processing unit is configured to timingly separate the pulses of the pulse pair. The timing of the separation indicates a status of the first current relative to a predetermined range.

In another embodiment of the track circuit, the transmit processing unit is configured to apply a second voltage to said track section if said first current is outside of the predetermined range. The second voltage has a different magnitude than the first voltage. The predetermined range is adjusted to correspond to a second current. The second current is related to the second voltage.

In another embodiment of the track circuit, the receive processing unit is configured to detect the second current.

In another embodiment of the track circuit, the receive processing unit is configured to detect the first current, and if the parameter of the first current is within the predetermined range, to communicate with the transmit processing unit so that the transmit processing unit records at least one of a magnitude of the first voltage or a magnitude of the first current.

In another embodiment of the track circuit, the track circuit calibration is complete when at least one of the transmit processing unit or the receive processing unit records at least one of the magnitude of the first voltage or the magnitude of the first current.

In another embodiment of the track circuit, the timing of the separation of the pulse pair indicates a required change in the first voltage to compensate for the leakage resistance.

In another embodiment of the track circuit, the receive processing unit is configured to determine if the first current is within the predetermined range.

In another embodiment of the track circuit, the receive processing unit is configured to separate the pulse pair by a designated time period adjusted by a time delta The time delta is indicative of a required change in the first voltage to compensate for the leakage resistance.

In another embodiment of a track circuit, the track circuit comprises a transmit processing unit and a receive processing unit for cooperatively monitoring and calibrating a track circuit. The transmit processing unit is coupled to a first end of a track section, and the receive processing unit is coupled to a second end of the track section. The transmit processing unit is configured to apply a first voltage to the track section. The receive processing unit is configured to detect a first current related to the first voltage and a leakage resistance between the first end and the second end of the track section. The receive processing unit is configured to transmit a pulse pair signal to the transmit processing unit indicating the status of the first current relative to a predetermined range. The transmit processing unit is configured to apply a different, second voltage to the track section if the first current is outside the predetermined range.

In another embodiment of the track circuit, a waveform of the second voltage relative to the first voltage is based at least in part on a polarity of pulses of the pulse pair signal.

In another embodiment of the track circuit, a waveform of the second voltage relative to the first voltage is based at least in part on a timing separation of pulses of the pulse pair. The separation is indicative of a direction and a magnitude of difference between the waveform of the first voltage and the waveform of the second voltage.

The above-described methods and systems enable automatic calibration of the transmitting voltage and the receiving current thresholds for a track circuit of a railroad. Track circuit calibration may be required when the environment changes and/or when the railroad conditions change. Accordingly, the need for manual setup and calibration is eliminated, thereby facilitating a reduction in the chance for error, in costs, and/or time associated with maintenance of the railroad. Moreover, the above-described methods and system increase the safety of the railroad.

At least one unit 103 and/or 105 may include, but is not limited to including, a microprocessor, microcontroller, a microcomputer, a programmable logic controller, an application specific integrated circuit, or any other programmable circuit. Therefore, the term processor, as used herein, is not limited to just those integrated circuits referred to in the art as computers, but broadly refers to microprocessors, microcontrollers, microcomputers, programmable logic controllers, application specific integrated circuits, and other programmable circuits, and these terms are used interchangeably herein.

As will be appreciated by one skilled in the art and based on the foregoing specification, the above-described embodiments of the invention may be implemented using computer programming or engineering techniques including computer software, firmware, hardware or any combination or subset thereof, wherein the technical effect is to calibrate a track circuit. Any such resulting program, having computer-readable code means, may be embodied or provided within one or more computer-readable media, thereby making a computer program product, i.e., an article of manufacture, according to the discussed embodiments of the invention. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Exemplary embodiments of system and method for automatic calibrating a railroad track circuit are described above in detail. The system and method illustrated are not limited to the specific embodiments described herein, but rather, components of the system may be utilized independently and separately from other components described herein. Further, steps described in the method may be utilized independently and separately from other steps described herein.

While the invention has been described in terms of various specific embodiments, those skilled in the art will recognize that the invention can be practiced with modification within the spirit and scope of the claims.

What is claimed is:

1. A method for calibrating a track circuit defined between a transmit processing unit and a receive processing unit, the transmit and processing units coupled at respective first and second ends of a track section, the method comprising:

applying a first voltage to the track section by the transmit processing unit;

receiving by the receive processing unit a first current related to the first voltage and a leakage resistance of ballast of the track section between the first end and the second end of the track section;

transmitting from the receive processing unit to the transmit processing unit a communication corresponding to a status of the leakage resistance, the communication including a pulse pair signal; and adjusting the first voltage based on the communication.

2. The method of claim 1, further comprising determining if the first current is within a predetermined range, wherein the first voltage is adjusted if the first current is outside the predetermined range.

3. The method of claim 1, the step of transmitting further comprising separating the pulse pair by a timing indicating a required change in the first voltage to compensate for the leakage resistance.

4. The method of claim 3, the step of transmitting further comprising the timing separating the pulse pair being a designated time period adjusted by a time delta, wherein the time delta indicates the required change in the first voltage to compensate for the leakage resistance.

5. The method of claim 4, further comprising:

applying a second voltage to the track section if the time delta is greater than zero, the second voltage having a different magnitude than the first voltage; and receiving by the receive processing unit a second current corresponding to the second voltage, and adjusting a predetermined range for the first current based on the leakage resistance for maintaining operation of the track circuit over a range of leakage resistance; and wherein the timing of the pulse pair is indicative of a direction of the transmitter adjustment.

6. The method of claim 3, wherein a magnitude of adjustment for the first voltage is communicated to the transmit processing unit by a magnitude of a change in the timing of the pulse pair.

7. The method of claim 1, further comprising operating the receive processing unit to detect the first current, and if a parameter of the first current is within a predetermined range, then communicating with the transmit processing unit so that the transmit processing unit records at least one of a magnitude of the first voltage or a magnitude of the first current.

8. The method of claim 7, further comprising operating at least one of the transmit processing unit or the receive processing unit such that when at least one of the magnitude of the first voltage or the magnitude of the first current is recorded, the track circuit calibration is complete.

9. The method of claim 1, wherein at least one of the transmit processing unit or the receive processing unit is coupled for communication with a remote system, said method further comprising operating the remote system for calibrating the track circuit from the remote system.

10. A track circuit comprising:

a receive processing unit configured to be coupled to a first end of a track section;

wherein the receive processing unit is configured to receive a current signal over the track section, the current signal related to a voltage signal applied to the track section by a transmit processing unit coupled to a second end of the track section and a leakage resistance of ballast of the track section between the first end and the second end of the track section; and wherein the receive processing unit is configured to transmit to the transmit processing unit a communication corresponding to a status of the leakage resistance, the communication including a pulse pair signal.

11. The track circuit of claim 10, wherein the receive processing unit is further configured to separate the pulse pair by a timing indicative of a required change in the voltage signal to compensate for the leakage resistance.

12. The track circuit of claim 11, wherein the timing separating the pulse pair is a designated time period adjusted by a time delta, wherein the time delta is indicative of the required change in the voltage signal to compensate for the leakage resistance.

13. The track circuit of claim 12, wherein a magnitude of the time delta is indicative of an amount and a direction of the required change in the voltage signal.

14. A track circuit comprising:

a transmit processing unit configured to be coupled to a first end of a track section;

wherein the transmit processing unit is configured to apply a voltage signal to the track section for reception of a current signal corresponding to the voltage signal by a receive processing unit coupled to a second end of the track section;

wherein the transmit processing unit is configured to receive a communication from the receive processing unit corresponding to a status of a leakage resistance of ballast of the track section between the first end and the second end of the track section, the communication including a pulse pair signal; and wherein the transmit processing unit is configured to adjust the voltage signal based on the pulse pair signal received from the receive processing unit to compensate for the leakage resistance.

15. The track circuit of claim 14, wherein the transmit processing unit is further configured to adjust the voltage signal based on a timing that separates the pulse pair, the timing indicative of a required change in the voltage signal to compensate for the leakage resistance.

16. The track circuit of claim 15, wherein the timing separating the pulse pair is a designated time period adjusted by a time delta, wherein the time delta is indicative of the required change in the voltage signal to compensate for the leakage resistance.

17. A track circuit comprising:

a remote system; and a transmit processing unit and a receive processing unit, said remote system configured for communication with at least one of said transmit processing unit or said receive processing unit;

wherein the transmit processing unit is coupled to a first end of a track section, the track section comprising a plurality of rails coupled in series and having the first end and a second end, and wherein the receive processing unit is coupled to the second end of the track section;

said transmit processing unit configured to apply a first voltage to said track section during a track circuit calibration operation, said receive processing unit configured to detect a first current related to the first voltage and a leakage resistance of ballast of the track section between the first end and the second end, said receive processing unit configured to transmit a pulse pair to the transmit processing unit indicative of a state of adjustment necessary in said first voltage to compensate for the leakage resistance; and said receive processing unit configured to timingly separate the pulses of said pulse pair, the timing of the separation indicating a status of the first current relative to a predetermined range.

18. The track circuit of claim 17, wherein the transmit processing unit is configured to apply a second voltage to said track section if said first current is outside of the predetermined range, said second voltage having a different magnitude than said first voltage, said predetermined range being adjusted to correspond to a second current, said second current related to said second voltage.

19. The track circuit of claim 18, wherein said receive processing unit is configured to detect said second current.

20. The track circuit of claim 17, wherein said receive processing unit is configured to detect said first current, and if said parameter of said first current is within said predetermined range, to communicate with said transmit processing unit so that said transmit processing unit records at least one of a magnitude of said first voltage or a magnitude of said first current.

21. The track circuit of claim 20, wherein said track circuit calibration is complete when at least one of said transmit processing unit or said receive processing unit records at least one of the magnitude of said first voltage or the magnitude of said first current.

22. The track circuit of claim 17, wherein the timing of the separation of the pulse pair indicates a required change in the first voltage to compensate for the leakage resistance.

23. The track circuit of claim 17, wherein the receive processing unit is configured to determine if the first current is within the predetermined range.

24. The track circuit of claim 17, wherein the receive processing unit is configured to separate the pulse pair by a designated time period adjusted by a time delta, wherein the time delta is indicative of a required change in the first voltage to compensate for the leakage resistance.

25. A track circuit comprising:

a transmit processing unit and a receive processing unit for cooperatively monitoring and calibrating a track circuit, said transmit processing unit coupled to a first end of a track section, and said receive processing unit coupled to a second end of the track section;

said transmit processing unit configured to apply a first voltage to said track section, said receive processing unit configured to detect a first current related to the first voltage and a leakage resistance of ballast of the track section between the first end and the second end of the track section;

said receive processing unit being configured to transmit a pulse pair signal to said transmit processing unit indicating the status of the first current relative to a predetermined range; and said transmit processing unit configured to apply a different, second voltage to said track section if the first current is outside the predetermined range.

26. The track circuit of claim 25, wherein a waveform of the second voltage relative to the first voltage is based at least in part on a polarity of pulses of the pulse pair signal.

27. The track circuit of claim 25, wherein a waveform of the second voltage relative to the first voltage is based at least in part on a timing separation of pulses of said pulse pair, the separation being indicative of a direction and a magnitude of difference between the waveform of the first voltage and the waveform of the second voltage.

* * * * *